US007556071B2

(12) United States Patent
Kokko

(10) Patent No.: US 7,556,071 B2
(45) Date of Patent: Jul. 7, 2009

(54) DEBARKING MECHANISM

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 250 days.

(21) Appl. No.: 10/599,877

(22) PCT Filed: Mar. 29, 2005

(86) PCT No.: PCT/FI2005/050108

§ 371 (c)(1),
(2), (4) Date: Oct. 12, 2006

(87) PCT Pub. No.: WO2005/102634

PCT Pub. Date: Nov. 3, 2005

(65) Prior Publication Data

US 2007/0079902 A1 Apr. 12, 2007

(30) Foreign Application Priority Data

Apr. 20, 2004 (FI) ..... 20045141

(51) Int. Cl.
*B27L 1/00* (2006.01)
*B27L 1/10* (2006.01)

(52) U.S. Cl. ..... 144/340; 144/208.1; 144/208.5

(58) Field of Classification Search ..... 144/208.1, 144/208.4–208.9, 340, 341
See application file for complete search history.

(56) References Cited

U.S. PATENT DOCUMENTS 5,394,912 A 3/1995 Hume
5,630,453 A 5/1997 Ishizawa
6,588,467 B2 * 7/2003 Havumaki et al. ..... 144/208.9
6,615,884 B2 * 9/2003 Havumaki et al. ..... 144/208.9
6,619,345 B2 * 9/2003 Havumaki et al. ..... 144/208.9
2003/0159760 A1 8/2003 Peetso et al.

FOREIGN PATENT DOCUMENTS

FI 28777 4/1957
FI 112181 10/2002
SE 8007901 5/1982
WO WO2005/102635 * 3/2005

OTHER PUBLICATIONS

Written Opinion mailed Sep. 6, 2005.
International Search Report mailed Sep. 6, 2005.

* cited by examiner

*Primary Examiner*—Shelley Self
(74) *Attorney, Agent, or Firm*—Nixon & Vanderhye P.C.

(57) ABSTRACT

A debarking mechanism including a number of rotatable debarking shafts extending parallel to an advancing direction (A) of the trees to be fed therethrough, which are provided with a number of teeth extending beyond the circumferential surface of the shaft and the debarking shafts being adapted to each other in such a way that the presently processed trees make a circular motion (C) in the debarking mechanism, in which motion the trees are forced upon the support surface constituted by the debarking shafts effected by the rotary motion of the debarking shafts. The uppermost debarking shaft has been fitted together with a guiding surface, the surface together with the uppermost debarking shaft forming a slot convergent in the direction of rotation of the debarking shaft.

14 Claims, 5 Drawing Sheets

DEBARKING MECHANISM

RELATED APPLICATIONS

This application is the US national phase of international application PCT/FI2005/050108 filed 29 Mar. 2005 which designated the U.S. and claims benefit of Finnish patent application Fl 20045141 filed 20 Apr. 2004, the entire contents of these applications are incorporated by reference.

BACKGROUND AND SUMMARY OF THE INVENTION

The invention relates to a debarking mechanism for the excortication or pretreatment of trees for separately performed final barking and for the expulsion of at least some of the removed barks from a wood flow passing through the debarking mechanism, said debarking mechanism comprising a number of rotatable debarking shafts extending parallel to the advancing direction of the trees to be fed therethrough, which are provided with a number of teeth extending beyond the circumferential surface of the shaft and adapted to strip bark off the presently processed trees transversely to the lengthwise direction of the trees and at the same time to convey the trees transversely relative to said shafts, and said shafts, together with the teeth thereof being adapted to constitute at least a section of a support surface, upon which the presently processed trees travel through the debarking mechanism, and said shafts being adapted to each other in such a way that the processed trees perform a circular motion in the debarking mechanism, in which motion the trees are forced upon the support surface constituted by the debarking shafts, by the action of their rotatory motion, in their turn into the upper position, from which they roll down to the lower position above the other trees being processed in the debarking mechanism.

This type of prior known debarking mechanisms are provided with finger plates between the uppermost debarking shaft and the side wall of the debarking mechanism—in some mechanisms also between the debarking shafts—to prevent trees from getting wedged between the debarking shaft and the side wall of the debarking mechanism or between two debarking shafts and thus to prevent the wedged tree from getting broken.

The barks can usually get out from between the debarking shaft and the fingerplate or between two debarking shafts. The barks getting off the trees in long strips, instead, cause problems by stuffing the gaps between the uppermost debarking shaft and the related fingerplates, thus causing the barks to gather into big lumps at these uppermost finger plates.

In order to eliminate these disadvantages, the debarking mechanism of the invention has been arranged in such a way, that the uppermost debarking shaft has been provided with a guiding surface, said guiding surface together with the uppermost debarking shaft forming a slot converging in the rotational direction of the debarking shaft. The mentioned guiding surface, on one hand, helps the barks to get into the said slot and, on the other hand, prevents the trees from getting into the slot between the guiding surface and the uppermost debarking shaft.

The guiding surface is preferably provided with grooves in order to arrange said guiding surface and the teeth of the uppermost debarking shaft interlocked.

A freely rotating roller or a roller rotated by a suitable driving apparatus has proved to be the most efficient form of application of the guiding surface.

In yet another preferable application of the invention, the higher the debarking shaft lies, the bigger the selected circumferential speed of the debarking shaft is. This arrangement, on one hand, prevents the trees from getting wedged between the debarking shafts and, on the other hand, causes the barks to get out from the debarking mechanism easier.

At least one of the debarking shafts, most preferably the uppermost debarking shaft, has been moved sideways towards the inner part of the debarking mechanism in such a way that the said debarking shaft makes the trees conveyed by the lower debarking shaft to change their direction of motion so that when dividing the motion into a horizontal and a vertical component, the horizontal component of motion points towards the inner part of the debarking mechanism.

The new position of the uppermost debarking shaft causes that the trees, at the best, cannot at all go over the uppermost debarking shaft, nor can the trees, as a result of the above, hinder the barks from going into the slot between the uppermost debarking shaft and the said guiding surface.

BRIEF DESCRIPTION OF THE FIGURES

The invention will now be described in more detail with reference to the accompanying drawings, in which.

DETAILED DESCRIPTION OF THE FIGURES

Figure 2:
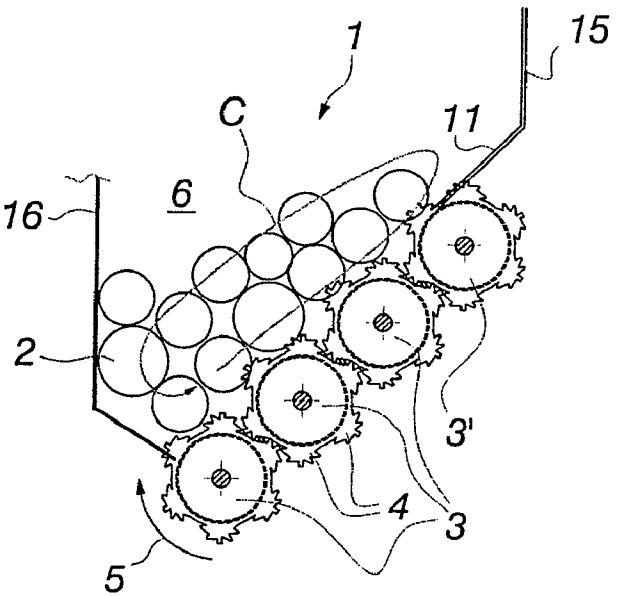
Prior art Fig. 2
FIG. 2 shows a section along a line II-II in FIG. 1.

The debarking mechanism 1 shown in the drawings is intended for the excortication or pretreatment of trees 2 for separately performed final barking and for the expulsion of at least some of the removed barks from a wood flow passing through the debarking mechanism. The debarking mechanism 1 is provided with a number of rotatable debarking shafts 3, 3' extending parallel to the advancing direction A (FIG. 1) of the trees 2 to be fed therethrough, said debarking shafts having each end thereof pivoted to the end plates 13 (FIG. 1) at the ends of the debarking mechanism 1. To rotate the shafts 3, 3', one end or both ends are provided with for example a sprocket 14. The shafts 3, 3' are rotated in the direction of the pile 5 (FIG. 2).

The debarking shafts 3, 3' are provided with a number of teeth 4 extending beyond the circumferential surface of the debarking shaft and adapted to strip bark off the presently processed trees 2 transversely to the longitudinal direction of the trees and at the same time to convey the trees transversely relative to said debarking shafts.

Figure 1:
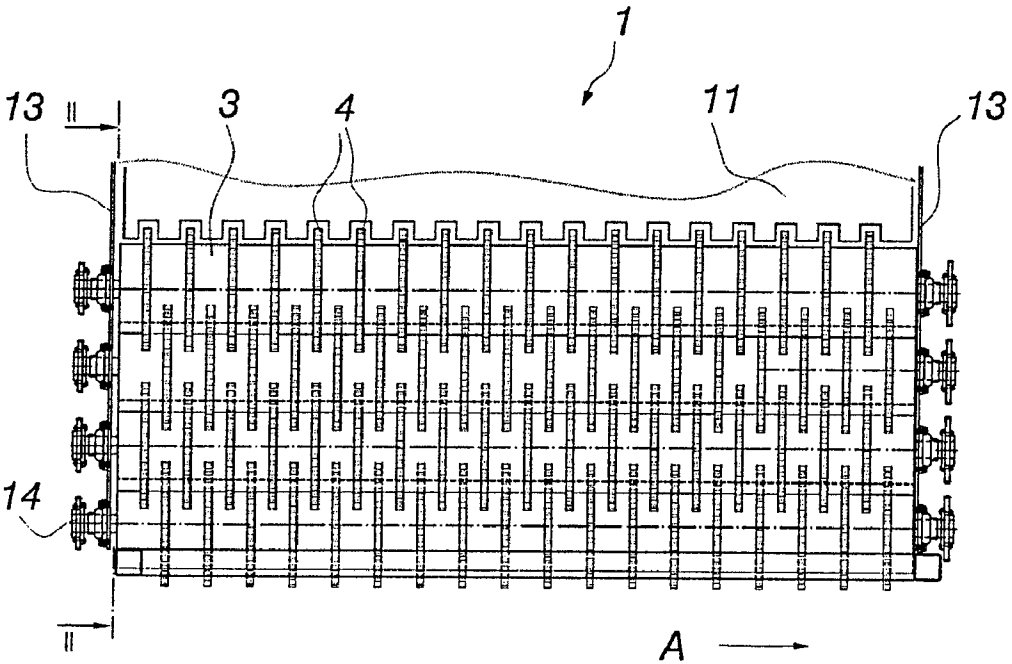
Prior art Fig. 1
FIG. 1 shows the debarking shafts of the state-of-the-art debarking mechanism in a schematic side view.

The debarking shafts 3, 3', together with the teeth 4 thereof, constitute a part of a support surface for carrying the trees 2 through the debarking mechanism 1. The FIGS. 1 and 2 show an example of a state-of-the-art mechanism comprising four debarking shafts 3, 3', said shafts being adapted relative to each other to form an inclined plane as best shown in FIG. 2. The debarking shafts 3, 3' form a sloping plane also in the advancing direction A of the trees. Other than that, the support surfaces comprise solid surfaces 15, 16 which are designed for providing, together with the support surface constituted by the debarking shafts, an open-ended chute extending from one end the debarking mechanism 1 of to another end.

The debarking shafts 3, 3' are adapted with each other so that the processed trees 2 perform a circulation motion C in the debarking mechanism, in which motion the trees 2 are positively fed on the support surface formed by the debarking shafts 3, 3' effected by the rotatory motion 5 in their turn into the upper position, from which they roll down into the lower position above the other trees 2 in the debarking mechanism 1.

In the state-of-the-art FIGS. 1 and 2 there is a fingerplate 11 above the uppermost debarking shaft 3', the purpose of said fingerplate being to prevent the trees from getting wedged between the uppermost debarking shaft 3' and the side wall of the debarking mechanism 1. The barks can usually get out from between the debarking shaft 3' and the fingerplate 11 or between two debarking shafts 3 and fall down onto the bark conveyor below (not shown).

However, especially the barks getting off in long strips cause sometimes problems by stuffing the slots between the uppermost debarking shaft 3' and the connected fingerplates 11, whereby the barks start gathering into big lumps at the fingerplates 11.

Figure 3:
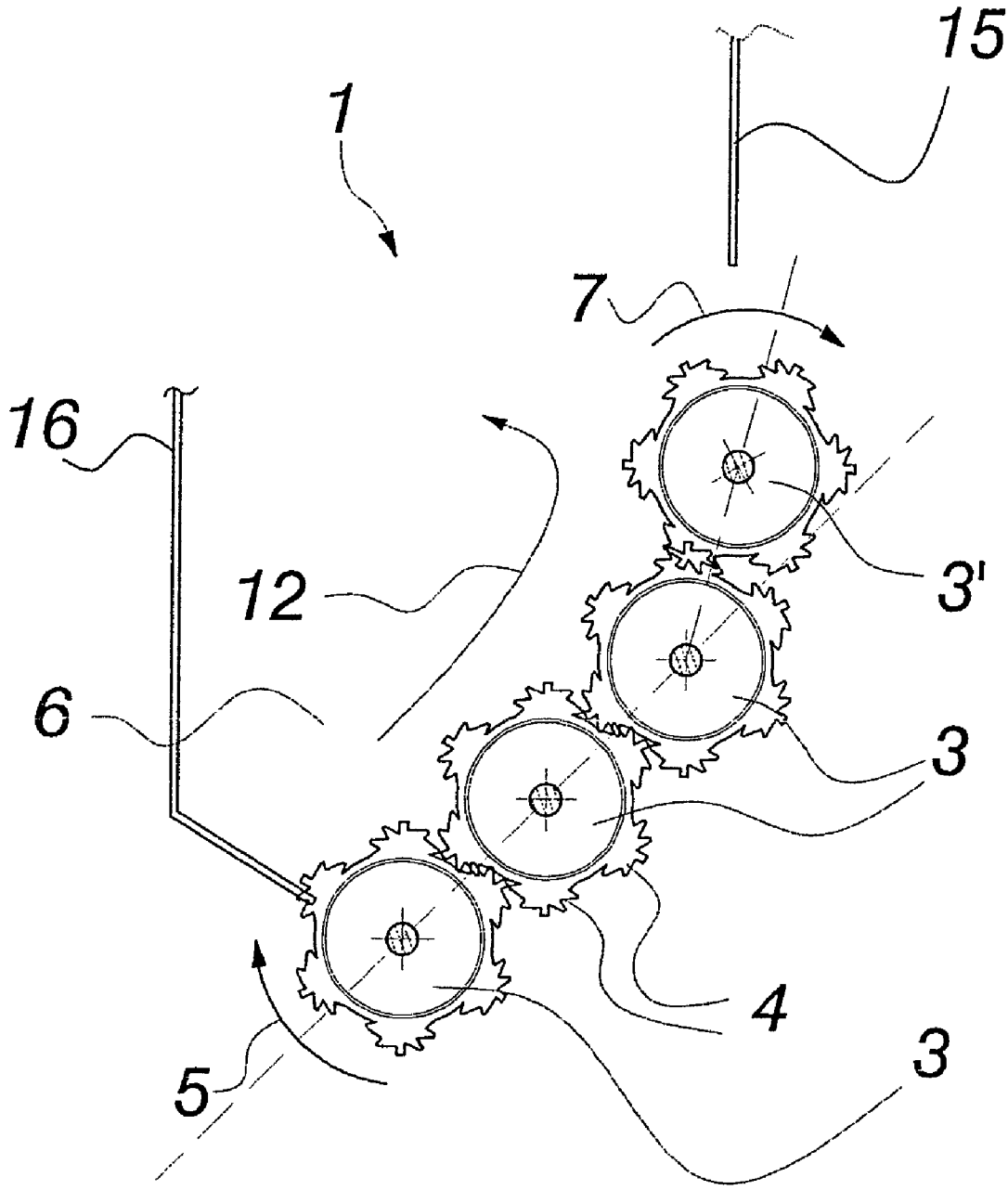
FIG. 3 shows a section picture consistent with FIG. 2 of the debarking mechanism in accordance with the first application of the invention.

For the elimination of the said problem, a diagrammatic solution is shown in FIG. 3. In this solution at least one debarking shaft, most preferably the uppermost debarking shaft 3', has been moved sideways towards the inner part 6 of the debarking mechanism 1, said debarking shaft forcing the trees 2 conveyed by the lower debarking shafts 3 to change their direction of motion so that when dividing the motion into a horizontal and a vertical component, the horizontal component of motion points at the inner part of the debarking mechanism 1. When the selected sideways movement of the debarking shaft 3' is large enough, the trees 2 are prevented from going over the uppermost debarking shaft 3'. Only the barks can go over the uppermost debarking shaft 3' and a free passage 7 has been arranged for the barks for their removal from the debarking mechanism 1.

In the example of FIG. 3 the said free passage 7 is formed by an opening arranged in the side wall 15 of the debarking mechanism 1 by the debarking shaft 3', through which the barks can freely fall down onto the bark conveyor underneath (not shown).

Figure 4:
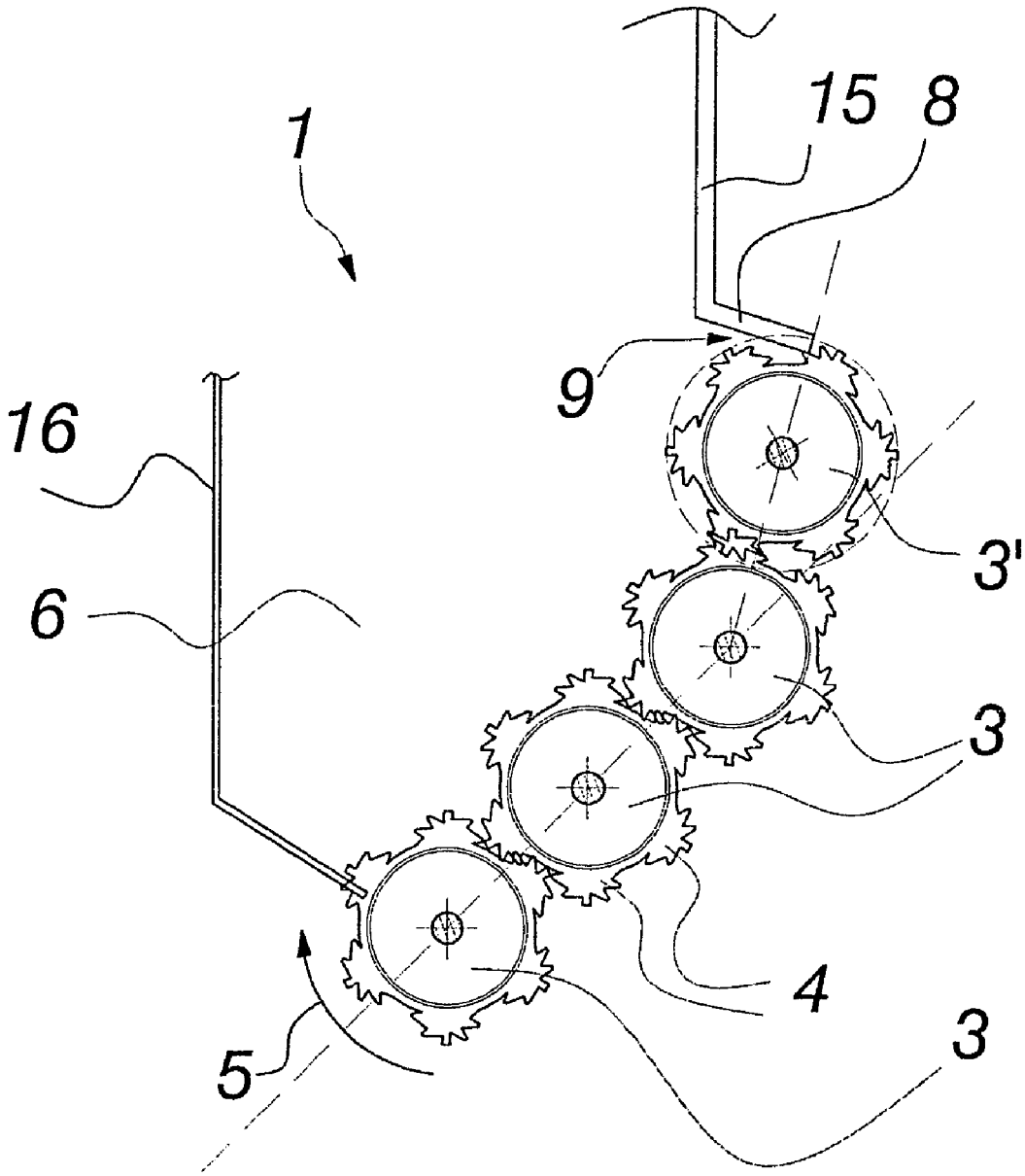
FIG. 4 shows a section consistent with FIG. 2 of the debarking mechanism in accordance with the second application of the invention.

In the solution according to FIG. 4, a solid guiding surface 8 has been adapted to the uppermost debarking shaft 3', said guiding surface together with the uppermost debarking shaft 3' forming a convergent slot 9 in the direction of rotation 5 of the debarking shaft 3'. In the example of FIG. 4 the guiding surface 8 is a plate-like straight surface but it can also have a different kind of form, for example an arched surface. The purpose of the guiding surface 8 is primarily to guide the barks as efficiently as possible out of the debarking mechanism 1 but at the same time to prevent trees 2 going occasionally over the uppermost debarking shaft 3' from getting out of the debarking mechanism 1 or from getting wedged between the uppermost debarking shaft 3' and the side wall 15 of the debarking mechanism 1. The guiding surface 8 has been adapted so that the barks conveyed by the uppermost debarking shaft 3' collide against it in a sharp angle while going towards the slot 9.

Figure 5:
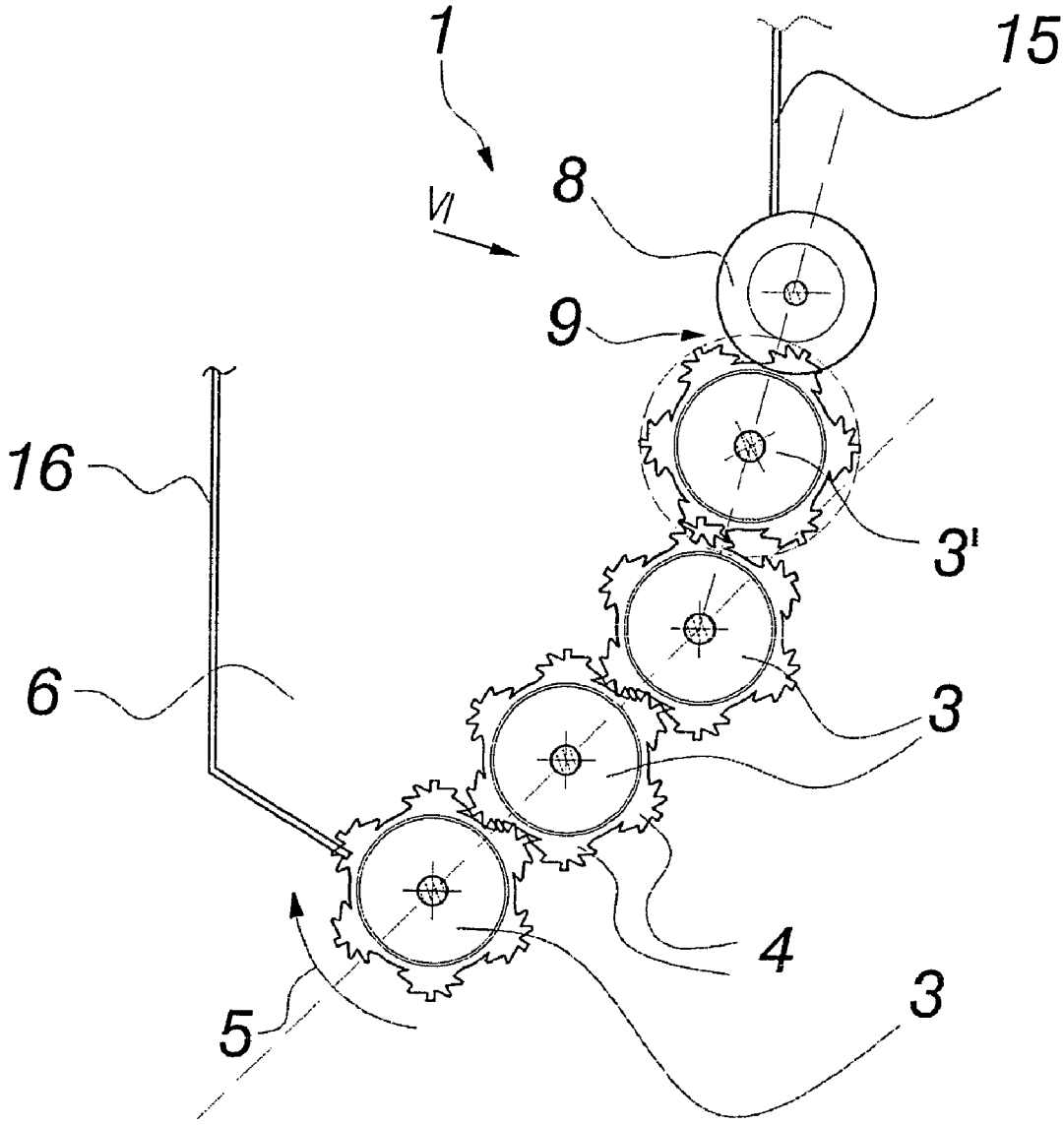
FIG. 5 shows a section consistent with FIG. 2 of the debarking mechanism in accordance with the third application of the invention.

In the application example of FIG. 5, the guiding surface 8 is formed by a toothless freely rotating or independently rotatable roller resembling the debarking shafts 3, 3' as to construction, in which case the teeth 4 of the uppermost debarking shaft force the barks to get out through the slot 9 between the uppermost debarking shaft 3' and the roller 8.

Figure 6:
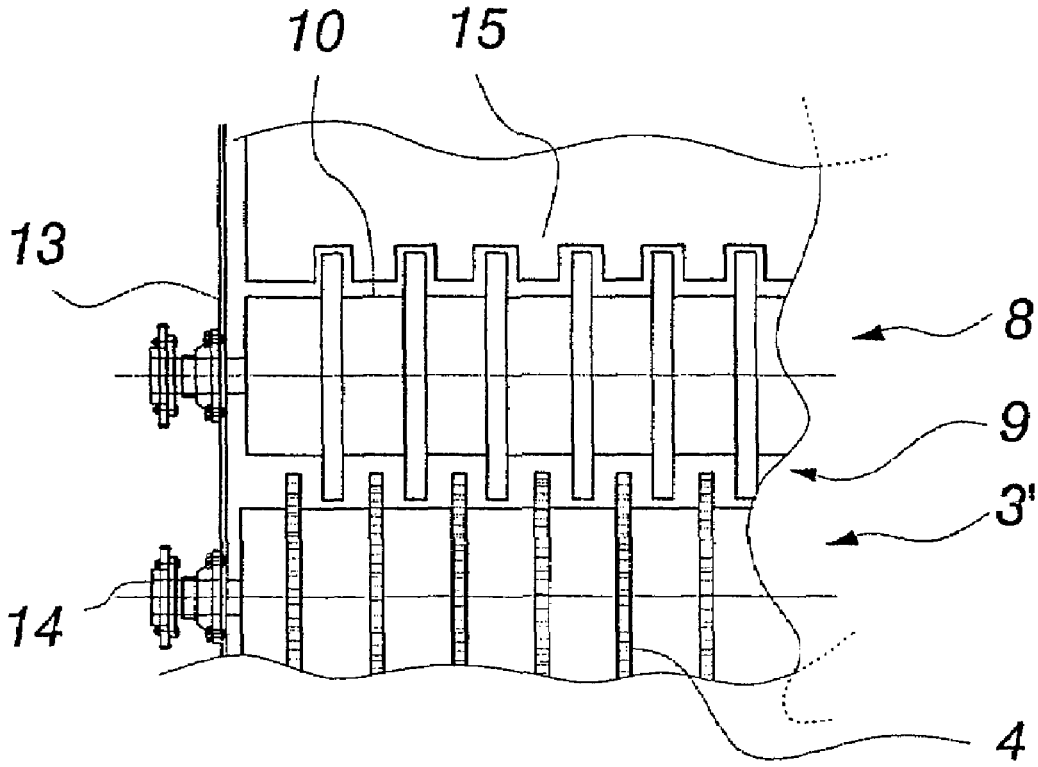
FIG. 6 shows a partial picture of the direction of pile VI in FIG. 5.

The guiding surface 8—regardless of whether it is a rotating or fixed guiding surface or whether the guiding surface is plate-formed, cylindrical or of another form—is preferably provided with grooves 10 in order to get the said guiding surface and the teeth 4 of the uppermost debarking shaft 3' interlocked and thus to form the slot 9 to the desired size (FIG. 6). Due to this arrangement the bark that, forced by the tooth 4, has at some point penetrated through the slot 9, cannot any more easily come back through the slot 9, and the adjacent teeth 4 force even the rest of the bark strip to penetrate through the slot 9. The movable guiding surface 8 constituted by the rotatable or freely rotating roller makes it still easier for the barks to get into the slot 9 and through it away from the debarking mechanism 1.

The circumferential speed of the debarking shaft 3, 3' has been preferably chosen the greater the higher the debarking shaft 3, 3' lies. This arrangement, on one hand, prevents the trees 2 from getting wedged between the debarking shafts 3, 3' and on the other hand makes the removal of barks from the debarking mechanism 1 easier.

The invention claimed is:

1. A debarker for removing bark from logs comprising:

a plurality of rotating debarking shafts arranged side-by-side and in a debarking plane, said shafts being parallel to an advancing direction of the logs through the debarker and include debarking features projecting from an outer shaft surface;

the debarking shafts in the debarking plane forming a support surface for the logs in the debarker, the debarking shafts rotating in a direction that deflects the logs and removed bark upward in a direction substantially transverse to the advancing direction;

an offset debarking shaft parallel to and adjacent one of the debarking shafts in the debarking plane, the offset debarking shaft including debarking features and the offset debarking shaft being offset in a direction upward from the debarking plane;

a guiding surface parallel to and upwards of the offset debarking shaft, and a slot between the guiding surface and the offset debarking shaft, wherein the slot converges along a direction aligned with a rotational direction of the debarking shaft.

2. A debarker as in claim 1 wherein the guiding surface is a rotating shaft without debarking features.

3. A debarker as in claim 1 wherein the debarking features are teeth extending outward from an outer cylindrical surface of the shafts.

4. A debarker as in claim 1 wherein the guiding surface includes grooves transverse to the offset debarking shaft and said grooves interlaced with the debarking features on the offset debarking shaft.

5. A debarker as in claim 1 wherein the guiding surface comprises at least one freely rotating roller.

6. A debarker as in claim 1 wherein the guiding surface comprises a rotating roller.

7. A debarker as in claim 1 further comprising a upstanding support surface opposite to the debarking shafts and a log vessel defined by and between the upstanding support surface and the debarking shafts.

8. A method for removing bark from logs in a debarker having a plurality of debarking shafts arranged side-by-side and in a debarking plane, an offset debarking shaft parallel to and adjacent one of the debarking shafts in the debarking plane, and a guiding surface parallel to and upwards of the offset debarking shaft, the method comprising:

advancing logs through the debarker in a direction generally parallel to debarking shafts and the debarking plane;

removing bark from the logs by rotating the debarking shafts which include debarking teeth that cut bark from logs abutting the rotating shafts;

by rotating the debarking shafts, forcing logs in the debarker to be deflected upwards, wherein the upward deflection causes bark removed from the logs to advance upward to the offset debarking shaft; and advancing the removed bark over the rotating offset debarking shaft and through a convergent slot formed between the offset debarking shaft and the guiding surface, wherein the slot is too narrower to pass the logs.

9. A method as in claim 8 wherein the direction of advancement of the logs through the debarker is generally horizontal and the direction in which logs are deflected upward in the debarker is generally vertical.

10. A method as in claim 8 wherein the guiding surface is a rotating shaft without teeth and the rotation of the guiding surface and the offset debarking shaft draws bark through the slot.

11. A method as in claim 8 wherein the guiding surface includes grooves transverse to the offset debarking shaft and the grooves interlace with the teeth of the offset debarking shaft.

12. A method as in claim 8 wherein the guiding surface includes at least one freely rotating roller and the method further comprises turning the guiding surface by the advancement of bark through the slot.

13. A method as in claim 8 wherein the guiding surface includes at a driven rotating roller and the method further comprises advancing the bark through the slot by the combined rotations of the rotating roller and the offset debarking shaft.

14. A method as in claim 8 wherein the upward deflection of the logs includes a generally oval circulation of logs in the debarker, wherein the oval circulation is transverse to the debarking shafts.

* * * * *